US007303651B2

(12) United States Patent
Asano et al.

(10) Patent No.: US 7,303,651 B2
(45) Date of Patent: Dec. 4, 2007

(54) INK JET RECORDING PAPER

(75) Inventors: Shinichi Asano, Tokyo (JP); Motoko Hiraki, Warabi (JP); Tomomi Takahashi, Tokyo (JP); Hiromasa Kondo, Saitama (JP); Takeshi Iida, Urayasu (JP); Ryu Kitamura, Yokoyama (JP)

(73) Assignee: Oji Paper Co., Ltd., Tokyo (JP)

( * ) Notice: Subject to any disclaimer, the term of this patent is extended or adjusted under 35 U.S.C. 154(b) by 507 days.

(21) Appl. No.: 10/494,843

(22) PCT Filed: Nov. 8, 2002

(86) PCT No.: PCT/JP02/11680

§ 371 (c)(1),
(2), (4) Date: May 5, 2004

(87) PCT Pub. No.: WO03/039881

PCT Pub. Date: May 15, 2003

(65) Prior Publication Data

US 2004/0261964 A1 Dec. 30, 2004

(30) Foreign Application Priority Data

Nov. 8, 2001 (JP) ..... 2001-342671

(51) Int. Cl.
*D21F 11/00* (2006.01)

(52) U.S. Cl. ..... 162/135; 162/205; 162/137; 162/158; 162/134; 428/32.1

(58) Field of Classification Search ..... 162/135, 162/137, 158, 205; 428/32.1
See application file for complete search history.

(56) References Cited

U.S. PATENT DOCUMENTS 5,275,846 A 1/1994 Imai et al.
5,647,935 A 7/1997 Hoshino et al.
5,670,242 A 9/1997 Asano et al.
5,750,200 A 5/1998 Ogawa et al.

FOREIGN PATENT DOCUMENTS

| | | |
|---|---|---|
| EP | 0 803 374 A2 | 10/1997 |
| EP | 1 038 691 A1 | 9/2000 |
| EP | 1 120 281 A1 | 8/2001 |
| JP | 02-274587 | 11/1990 |
| JP | 08-011423 | 1/1996 |
| JP | 08-067064 | 3/1996 |
| JP | 08-164668 | 6/1996 |
| JP | 10-071764 | 3/1998 |
| JP | 10-086510 | 4/1998 |
| JP | 10-181184 | 7/1998 |
| JP | 10-315610 | 12/1998 |
| JP | 11-147361 | 6/1999 |
| JP | 11-268405 | 10/1999 |
| JP | 2000-37944 | 2/2000 |
| JP | 2001-353957 | 12/2001 |

OTHER PUBLICATIONS

Asakura-shoten. "Fine Powder Handbook" (1991), p. 52.
"Taikabutsu", (1989) The Technical Association of Refractories, Japan, vol. 41 Issue 6, pp. 297-303.

*Primary Examiner*—Mark Halpern
(74) *Attorney, Agent, or Firm*—Knobbe Martens Olson & Bear, LLP

(57) ABSTRACT

Ink jet printing paper capable of providing, by using a low permeablity or a nonpermeable supporting sheet, a high surface glossiness and a high dot reproducibility of a silver halide photograph level, an excellent absorptivity of ink, and a high recording density, and preventing cockling by ink solvent, comprising the low permeablity or the nonpermeable supporting sheet, at least one ink receiving layer coated on the supporting sheet, and a luster layer coated on the ink receiving layer, the ink receiving layer in contact with the luster layer comprising pigment, as a main component, having a specific surface area-based mode diameter of pore distribution of 100 nm or less and an average secondary particle size of 1.3 μm or less, and the luster layer comprising pigment, as a main component, having an average primary particle size of 5 to 100 nm.

5 Claims, 1 Drawing Sheet

INK JET RECORDING PAPER

This application is the U.S. National Phase under 35 U.S.C. §371 of International Application PCT/JP02/11680, filed on Nov. 8, 2002, which claims priority of Japanese Patent Application No. 2001-342671, filed on Nov. 8, 2001. The International Application was published under PCT Article 21(2) in a language other than English.

TECHNICAL FIELD

The present invention relates to ink jet printing paper. In particular, the present invention relates to ink jet printing paper having excellent appearance including a high surface glossiness, high smoothness, etc., and excellent recording properties including a high ink absorptivity, a high dot reproducibility, a high recording density, and so forth.

BACKGROUND ART

Ink jet recording system in which aqueous ink is ejected through a nozzle having fine pores to form an image on recording paper is widely used in terminal printers, facsimiles, plotters, sheet feeding printers, etc., due to low noise during recording, ease of performing color recording, possibility of performing high-speed recording, lower cost than other printing devices, and so forth.

Recently, demand has increased for high performance of printing paper which is used in an ink jet recording system due to increasing wide spread use of printers and development thereof to enhance high definition and high-speed performance as well as appearance for digital cameras in the field.

Accordingly, ink jet printing paper having excellent recording properties including a high ink absorptivity, a high recording density, a high water resistance, and, in particular, a high image quality and surface glossiness equivalent to a silver halide photograph is strongly awaited.

As a method for imparting glossiness to ink jet printing paper, a method in which the surface of a coating layer is smoothened by being passed between rollers to which pressure or temperature is applied using a device, such as a super calender, (i.e., calender finish) is generally known.

However, the glossiness of printing paper obtained by the calender finishing is not sufficient. In addition, there are problems in that the ink absorptivity thereof is reduced due to reduction of voids in a coating layer, and hence, feathering tends to be easily caused.

Other than the above-mentioned calender finishing, a number of methods have been proposed which improve the glossiness of paper by providing an ink receiving layer formed by an ink absorbing resin, such as starch, gelatin, water-soluble cellulose resin, polyvinyl alcohol, polyvinyl pyrrolidone, denatured polyurethane, on a luster surface of a smooth plastic film or a resin coated paper.

However, although the printing paper obtained by the above methods have some degree of glossiness, the ink absorptivity thereof is not sufficient and ink drying speed is slow. Accordingly, it is not easy to handle the printing paper and there are problems that uneven ink absorption tends to be caused and that water resistance is low and curl is caused.

On the other hand, a method in which a coating layer is provided which includes ultra fine pigment powder of colloidal silica having small particle size is proposed in, for example, Japanese Laid-open Patent Application No. Hei. 2-274587, Japanese Laid-open Patent Application No. Hei. 8-67064, Japanese Laid-open Patent Application No. Hei. 8-118790, Japanese Laid-open Patent Application No. 2000-37944, and Japanese Laid-open Patent Application No. 2001-353957.

However, although the printing paper obtained by the above method has a glossiness of some degree, voids are not sufficiently formed in the coating layer, and a satisfactory ink absorptivity cannot be obtained.

Ink jet printing sheet having at least a layer including synthetic silica having an average particle size of primary particle of 50 nm or less formed by a gas phase method and a layer including a colloidal silica in that order viewed from a supporting sheet is proposed in Japanese Laid-open Patent Application No. 2000-37944. However, although the glossiness and anti-abrasion property thereof can be improved, its void rate is reduced by the primary powder, such as colloidal silica, and hence, the ink absorptivity thereof tends to be lowered. Also, if the coating amount is reduced in order to maintain the ink absorptivity, interference patterns are generated, lowering the quality of the luster surface, and a satisfactory glossiness cannot be obtained.

Also, ink jet printing sheet having at least a layer including synthetic silica having an average particle size of primary particle of 30 nm or less formed by a gas phase method and a layer including cationic colloid particles in that order viewed from a supporting sheet is proposed in Japanese Laid-open Patent Application No. 2001-353957. However, although feathering of image after printing and water resistance may be improved, there is a problem that the ink absorptivity thereof is lowered as in Japanese Laid-open Patent Application No. 2000-37944.

As described above, a method for improving glossiness without significantly decreasing ink absorbing speed is not disclosed in any of Japanese Laid-open Patent Application No. Hei. 2-274587, Japanese Laid-open Patent Application No. Hei. 8-67064, Japanese Laid-open Patent Application No. Hei. 8-118790, Japanese Laid-open Patent Application No. 2000-37944, Japanese Laid-open Patent Application No. 2001-353957, and so forth.

As a method for imparting glossiness other than the methods described above, so called cast coating methods are known in which a wet coating layer is pressed against a heated calender roll having a specular surface and dried to copy the specular surface (for example, refer to U.S. Pat. No. 5,275,846 and Japanese Laid-open Patent Application No. Hei 7-89220).

Cast coating methods which are generally known are as follows:

(1) a wet cast coating method in which pigment composition having pigment and adhesive as main components is coated on a base paper, and while a coating layer is in a wet state, it is pressure welded against a specular-finished heated calender roll and dried to obtain a glossy finish;

(2) a gel cast coating method in which a wet state coating layer is gelatinized by acid, salt, heat, and so forth, and is pressure welded against a heated calender roll and dried to obtain a glossy finish; and (3) a rewet cast coating method in which a coating layer of wet state is once dried and then wet plasticized using a rewetting solution, and is pressure welded to a heated calender roll and dried to obtain a glossy finish.

Although each of the above wet casting methods are recognized as a distinguished techniques among skilled persons in the field, the methods are similar in terms of pressure welding a surface of a coating layer in a wet plasticizing state against a calender roll, drying, and separating from a heated calender roll to copy a specular surface.

Cast coating paper obtained by the above wet casting method is mainly used for high quality printing matter since it has a high surface glossiness and a high surface smoothness and excellent printing effect can be obtained as compared with normal printing paper which is calender finished.

However, there are various problems for applying the cast coating paper to ink jet printing paper. For example, the above-mentioned cast coating paper acquires high glossiness due to the presence of a film-forming material, such as an adhesive, contained in the pigment composition forming a coating layer, which copies the surface of a calender roll of a cast coater as disclosed in U.S. Pat. No. 5,275,846. The porosity of the coating layer is lost by the presence of the film-forming material, and absorptivity of ink during ink jet recording is significantly reduced. For that reason, it is important to make the coating layer porous so that it easily absorbs ink and improves the ink absorptivity of the cast coating paper. On the other hand, in order to obtain a high quality image equivalent to a silver halide photograph, it is necessary that a uniform film be formed in the coating layer so that ink which is ejected through fine nozzles of an ink jet printer can be reproduced on the paper without cracks. However, it is extremely difficult to realize both a uniform film having no cracks and a porosity using a conventional wet cast coating method.

Also, in the cast coating paper, it is necessary that water components in the coating material be vaporized through the backside because the wet coating material is contacted the calender roll and dried. For this reason, vapor will remain in the coating layer if a supporting sheet having a significantly low permeability, such as resin coated paper or film, is used. Since the volume of vapor is much larger than the volume of water, the captured vapor will raise the supporting sheet. At that time, the weakest portion of the coating layer would be damaged.

For example, if the bonding of the coating material to the specular-finished heated calender roll is weak, peeling occurs at the boundary between the coating layer and the calender roll, and a so-called insufficient adherence that causes insufficient copying of the specular surface of the calender roll is caused. On the other hand, if the strength of an undried coating layer is weaker than the bonding strength between the calender roll and the coating material, the coating layer will be broken inside thereof and a part of the coating material will attach on the surface of the calender roll to stain the calender roll. In either case, a clear casting surface cannot be formed and becomes a cause of problems in terms of quality and operation.

Accordingly, a great difficulty is associated with obtaining a cast coating paper using a low permeability or nonpermeable supporting sheet, such as a resin coated paper and film.

Also, it is known that a defect called cockling may be observed during ink jet printing in which printing paper is elongated and wrinkled due to the effect of solvent, such as water, contained in ink. Cockling not only disturbs the appearance of printing matter but also makes the printing paper contact a recording head to stain the printing paper. This may lead to breakage of the printing paper or malfunction of the recording head.

In order to prevent the generation of cockling, it is effective to use a supporting sheet which is not enlarged by the solvent of ink, or to provide a layer between an ink receiving layer and a supporting sheet, which does not permeate the solvent of ink. For example, if a low permeability or nonpermeable supporting sheet, such as resin coated paper and film, is used, cockling can be effectively prevented.

That is, an object of the present invention is to provide ink jet printing paper including a low permeability or nonpermeable supporting sheet, having a high surface glossiness and a high dot reproducibility equivalent to a silver halide photograph level, the ink jet printing paper having excellent ink absorptivity and ink absorbing rate, and a high recording density, and which is capable of preventing cockling by ink solvent.

DISCLOSURE OF THE INVENTION

The inventors of the present invention found that ink jet printing paper having a high surface glossiness of a silver halide photograph level and a coating layer with no cracks, and excellent in dot reproducibility, ink absorptivity, ink absorbing rate, and recording density, and capable of preventing cockling by ink solvent can be obtained by providing at least one ink receiving layer on a low permeability or nonpermeable supporting sheet; applying a coating solution onto the ink receiving layer to form a luster layer; forming a coating solution layer by making the supporting sheet pass through a calender roll and a press roll so that the surface to which the coating solution is applied contacts the calender roll while the coating solution is in a wet state or a half-dry state; and immediately separating the coating solution layer from the calender roll, and completed the present invention.

That is, the present invention includes the following aspects:

(1) Ink jet printing paper, including: a low permeability or nonpermeable supporting sheet; at least one ink receiving layer coated on the supporting sheet; and a luster layer coated on the ink receiving layer, wherein the ink receiving layer in contact with the luster layer including pigment, as a main component, having a specific surface area-based mode diameter of pore distribution of 100 nm or below and an average secondary particle size of 1.3 μm or below, and the luster layer including pigment, as a main component, having an average primary particle size of 5 to 100 nm.

(2) Ink jet printing paper according to (1), wherein 75° surface glossiness (based on JIS P 8142) is 70% or higher and image clarity (based on JIS H 8686-2) measured using an optical comb having a width of 2.0 mm is 55% or higher.

(3) Ink jet printing paper according to (1), wherein a porosity a % of the ink receiving layer and a porosity b % of the luster layer satisfy following equations:

$$a>b,\ a-b>25,\ 45<a<80,\ \text{and}\ 10<b\leqq 45$$

(4) Ink jet printing paper according to (1), wherein a thickness of the luster layer is 0.02-4 μm, and the thickness is 1/10 or less of a total thickness of the ink receiving layer.

(5) Ink jet printing paper according to (1), wherein at least one layer of the ink receiving layer includes pigment and adhesive, the adhesive being polyvinyl alcohol having a polymerization degree of 3000-5000.

(6) Ink jet printing paper according to (1), wherein the supporting sheet is a film or resin coated paper.

(7) Ink jet printing paper according to any one of (1)-(6), wherein the luster layer is formed using a calender roll.

BEST MODE FOR CARRYING OUT THE INVENTION

Figure 1:
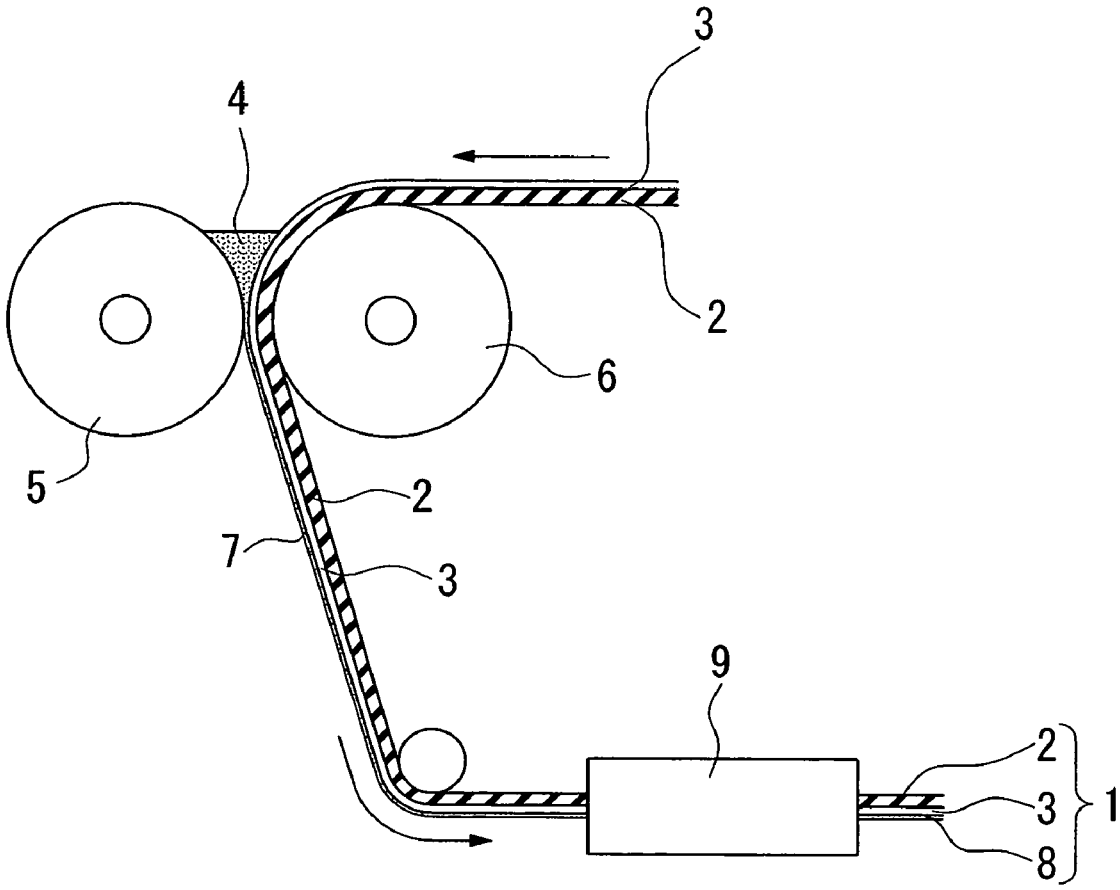
FIG. 1 is a diagram showing a preferred embodiment according to the present invention.

The ink jet printing paper according to the present invention is preferably manufactured by the following embodiments of manufacturing methods (a)-(e).

(a) A method for manufacturing ink jet printing paper including at least one ink receiving layer formed on a low permeability or nonpermeable supporting sheet and a luster layer formed on the ink receiving layer, the method including:

an ink receiving layer forming process in which at least one ink receiving layer is formed on the supporting sheet;

a coating solution supplying process in which a coating solution is supplied to form a luster layer on the ink receiving layer; and a pressing process in which after a coating solution layer is formed on the supporting sheet by passing between a calender roll and a press roll, to which a load is applied, so that a surface to which the coating solution has been supplied contacts the calender roll, the supporting sheet is separated from the calender roll while the coating solution layer in a wet state or in a half-dry state.

(b) A method for manufacturing ink jet printing paper according to (a) further including a drying process in which the coating solution layer is dried after the pressing process.

(c) A method for manufacturing ink jet printing paper according to (a) wherein the luster layer includes pigment having an average primary particle size of 5-100 nm.

(d) A method for manufacturing ink jet printing paper according to (a) wherein a specific surface area-based mode diameter of pore distribution of the ink receiving layer in contact with the luster layer is only 100 nm or less.

(e) A method for manufacturing ink jet printing paper according to (a) wherein the supporting sheet is a film or resin coated paper.

FIG. 1 is a diagram showing a preferred embodiment of the present invention.

In this embodiment, first of all, an ink receiving layer 3 is formed on a low permeability or nonpermeable supporting sheet 2 (an ink receiving layer forming process). Then, the supporting sheet 2 is placed between a calender roll 5 and a press roll 6 so that the ink receiving layer 3 contacts the calender roll 5. After this, a coating solution 4 for forming a luster layer is supplied onto the ink receiving layer 3 so as to form a coating solution reservoir above the tangent line connecting the calender roll 5 and the press roll 6 (a coating solution supply process). Then, while the coating solution 4 is in a wet state or a half-dry state, the supporting sheet 2 is passed between the calender roll 5 and the press roll 6 to which pressure is applied so that a surface supplied with the coating solution 4 contacts the calender roll 5 to form a coating solution layer 7, and immediately after this, the coating solution layer 7 is separated from the calender roll 5 (a pressing process). Then, it is dried (i.e., humidity is adjusted) using a dryer 9 to obtain ink jet printing paper 1 including the supporting sheet 2, the ink receiving layer 3, and a luster layer 8.

Hereinafter, each of the processes will be explained in detail.

<Ink Receiving Layer Formation Process>

In the method for manufacturing ink jet printing paper according to the present invention, the ink receiving layer formation process is firstly carried out in which at least one ink receiving layer 3 is formed on the low permeability or nonpermeable supporting sheet 2.

(Supporting Sheet)

In the present invention, the low permeability or nonpermeable supporting sheet means a supporting sheet preferably having a permeability of 500 seconds or longer, or more preferably 1,000 seconds or longer. The permeability may be expressed by an air permeability which is generally known as a parameter for evaluating porosity of paper or unwoven fabric. The air permeability is expressed by a time required by 100 ml of air to pass through a test piece having a surface area of 645 $mm^2$, and this is specified in JIS P 8117 ("air permeability testing method for paper and paperboard").

As described above, in a conventional cast coating process, water components contained in a coating material is vaporized through a supporting sheet when a cast coating layer is dried. Accordingly, a higher air permeability of a supporting sheet used for cast coating is conventionally preferable. However, in the present invention, it is not necessary to stick to the air permeability. On the contrary, it is preferable that the supporting sheet not allow permeation of water or water vapor in order to prevent cockling. Accordingly, the material properties of a supporting sheet used in the present invention are not limited as long as the supporting sheet is of low permeability or nonpermeable member having a flat surface.

Examples of preferable supporting sheets include, for example, synthesized paper typically "Yupo" (a product of Yupo Corporation) which is obtained by drawing polypropylene and being subjected to a special process, film of cellophane, polyethylene, polypropylene, soft polyvinyl chloride, hard polyvinyl chloride, polyester, etc., and resin coated paper in which a surface of a base material, such as paper, is coated with a resin, such as a polyethylene resin and a polypropylene resin. Among them, use of resin coated paper in which a surface of paper is coated with a polyethylene resin containing titanium oxide is preferable due to its finishing appearance equivalent to a photographic paper.

For the case in which the supporting sheet is resin coated paper, the thickness of a polyethylene resin is not particularly limited. When resin coated paper which is coated with a polyethylene resin is used, for example, the thickness of the polyethylene resin layer is preferably 3-50 μm, and more preferably 5-40 μm. If the thickness of the polyethylene layer is less than 3 μm, defects, such as holes, tends to be easily caused in the polyethylene resin layer during the resin coating process. Also, it becomes difficult to control the thickness, and smoothness is hardly obtained. If the thickness exceeds 50 μm, on the other hand, obtained effects are small with respect to necessary cost, and it is not economically effective.

In addition, it is preferable to subject the resin layer surface to a corona discharge process, or to provide an anchor coating layer thereon in order to increase the adhering property with an ink receiving layer which will be described later.

Also, for the case where paper is used as a base material of resin coated paper, one which is produced by using wood pulp as a main material is preferably used as the paper base material. Various chemical pulp, mechanical pulp, and recycled pulp may be suitably used as the wood pulp. A beating degree of a beater may be adjusted to adjust paper strength, smoothness, and suitableness as paper, etc., of the pulp. Although the beating degree is not particularly limited, about 250-550 mL (CSF: JIS-P-8121) is a generally preferable range. Also, chlorine free pulp, such as a so-called ECF and TCF pulp, may be suitably used. Moreover, pigment may be added to the wood pulp if necessary. As a pigment, talc, calcium carbonate, clay, kaolin, sintered kaolin, silica, zeolite, and so forth may be suitably used. Although the degree of opacity and smoothness can be improved by adding pigment, there is a danger that paper strength will be lowed by an excessive addition of pigment, and it is preferable that the adding amount of pigment be in the range of about 1-20% by mass of wood pulp.

(Ink Receiving Layer)

In the present invention, at least one ink receiving layer is formed on a low permeability or nonpermeable supporting sheet. At least one layer of the ink receiving layer includes pigment and adhesive, and may further include a cationic compound if necessary.

According to the present invention, one or more than one ink receiving layers may be formed. If plural of ink receiving layers are present, it is possible to use different pigment and adhesive for each one of the ink receiving layers. At that time, if the ink receiving layer consists of two layers, for example, the glossiness of an ink receiving layer (the first layer) which is adjacent to a luster layer may be increased by adding extremely fine pigment thereto, and another pigment whose size is greater than the above-mentioned pigment may be used for another ink receiving layer (the second layer) which is adjacent to a supporting sheet to increase the ink absorptivity thereof. Accordingly, both the degree of glossiness and ink absorptivity can be maintained or improved while maintaining the ink absorptivity of the first layer to be low.

Examples of the pigment which is used for an ink receiving layer contacting the luster layer, include transparent or white pigment, such as colloidal silica, amorphous silica, alumina, aluminum hydroxide, magnesium carbonate, calcium carbonate, kaolin, and sintered kaolin, and these may be used singularly or in combination of two or more.

Among them, use of colloidal silica, alumina, or amorphous silica is particularly preferable. In particular, since amorphous silica is secondary powder and has void therein, it is less likely that problems in ink absorptivity will occur even at low pigment/resin percentage as compared with a case where colloidal silica or alumina, which are of primary powder, is used, and hence, use of amorphous silica is particularly preferable.

As amorphous silica, a silica fine powder dispersed solution obtained by using a solution in which silica fine power having a specific surface area measured by nitrogen absorption method of 300 $m^2/g$ to 1000 $m^2/g$ and a pore volume of 0.4 ml/g to 2.0 ml/g is dispersed in a colloidal state as a seed solution, adding a small amount of feeding solution including activated silic acid aqueous solution and/or alkoxy silane each time in the presence of alkali, and growing the silica fine powder until having a specific surface area measured by nitrogen absorption method of 100 $m^2/g$ to 400 $m^2/g$, average secondary particle size of 20 nm to 300 nm, and a pore volume of 0.5 ml/g to 2.0 ml/g so as to be dispersed in a colloidal state may be employed.

When amorphous silica is used in an ink receiving layer contacting a luster layer, it is preferable to use one having an average primary particle size of 3-70 nm, and it is more preferable to use one having an average primary particle size of 5-40 nm. Also, an average secondary particle size of amorphous silica is preferably 1.3 μm or less, more preferably between 10 and 700 nm. If the average secondary particle size is 1.3 μm or less, it becomes possible to make the surface area based mode diameter of pore distribution of 100 nm or less, and hence, a coating layer having no cracks can be easily obtained. In addition, the recording density thereof may increase since the dot reproducibility and ink absorptivity are enhanced, and the transparency of the ink receiving layer is improved.

In this specification, the average secondary particle size is measured by stirring 5% silica dispersion using a homogenizing mixer rotated at 5,000 rpm for 30 minutes, applying the dispersion as a sample immediately after the mixing, observing the sample under electron microscope (SEM and TEM) to take electron micrograph enlarged by ten thousands to four hundred thousands times, and measuring and averaging the Martin diameter of secondary particles within 5 square centimeters (refer to "Fine powder handbook", Asakura-shoten, p. 52, 1991).

Methods for manufacturing pigment which has the average secondary particle size of 1.3 μm or less are not particularly limited. Such pigment may be obtained by, for example, a method in which aggregated raw material of commercially available synthesized amorphous silica, etc., or precipitate obtained by chemical reactions in a liquid phase is pulverized using a mechanical means, a sol-gel method utilizing hydrolysis of metal alkoxide, hydrolysis at high temperatures in a vapor phase, and so forth. Examples of the mechanical means include ultrasonic waves, a high speed rotation mill, a roller mill, a vessel driving medium mill, a medium stirring mill, a jet mill, a sand grinder, a nanomizer, and so forth.

Also, although the specific surface area of fine pigment is not particularly limited, it is preferable that the specific surface area be 150 $m^2/g$ or greater. Here, the specific surface area of fine pigment means the surface area obtained by drying fine pigment at 105° C., measuring the nitrogen absorbing-desorbing isotherm of obtained powder sample using the measuring device SA 3100, a product of Coulter Co., after vacuum degassing for two hours at 200° C., and calculating the specific surface area thereof using the t-method. The specific surface area is a surface area of fine powder per mass, and the larger the value of the specific surface, the smaller the primary particle size thereof and the shape of secondary particle becomes complicated. Accordingly, it is considered that the larger the specific surface area the greater the volume inside fine pores, and hence the ink absorptivity thereof is improved.

The surface area based mode diameter of pore distribution means a maximum value obtained when the specific surface area pore diameter distribution is calculated using the following method.

According to the present invention, the pore diameter distribution means the distribution of a diameter of voids (pore) formed among particles in the recording layer, which is measured using a mercury squeezing method. The distribution of pore diameter can be obtained by calculating a pore diameter distribution (differential curve) from a void amount distribution curve obtained by the mercury squeezing method. The mercury squeezing method is also called a mercury porosymmetry and it is widely used for measuring pore structure (i.e., pore diameter or pore volume) of porous material as described in "Taikabutsu", Vol. 41, Issue 6, pp. 297-303, 1989. The principal of the measurement utilizes a large surface tension of mercury due to which mercury cannot enter the inside of pores of a porous material without applying pressure. That is, the relationship between the applied pressure to mercury and the diameter of a pore into which mercury can enter may be expressed by the following general formula (1):

$$P=-4\sigma \cos \theta/D \quad (1)$$

where P is pressure (psi) necessary for mercury to enter the inside of pores;

σ is surface tension of mercury (480 dyn/cm);

θ is contact angle of mercury (140°); and

D is diameter of a pore (μm).

By substituting a value of σ and θ, a general formula (2) for calculating the diameter of a pore D is obtained.

$$D=213/P \quad (2)$$

The pore diameter distribution is obtained by: measuring the volume of mercury which entered pores, i.e., pore volume V, while gradually varying pressure applied to mercury based upon the above-mentioned principle; drawing a curve expressing the relationship between the pore diameter D and the pore volume V which is converted in accordance with the equation (2) above; and plotting the differential coefficient (dV/dD) of the curve in the vertical axis and the pore diameter D in the horizontal axis. The pore diameter distribution curve generally has 1 or 2 maximum values.

According to the present invention, in order to avoid the influence of a supporting sheet, an ink receiving layer is formed on a film and then the ink receiving layer is peeled off using a cutter, etc., to make measurements. For the case where the measurements are made on a film, a film is used whose pore distribution can be ignored.

The glossiness of a recording layer becomes higher as the pore diameter becomes smaller. According to the present invention, in order to obtain an ink jet recording body having the glossiness of a silver halide photograph level, the maximum value of the pore diameter distribution is present at 100 nm or less, preferably 80 nm or less, and more preferably 70 nm or less. If a maximum value larger than 100 nm is present, the glossiness and dot reproducibility are reduced, and the recording layer tends to be easily cracked.

Also, for the case where the ink receiving layer consists of multiple layers, for example, two layers, the layer which does not contact the luster layer may contain pigment which is the same as one used for the layer which contacts the luster layer.

A preferable pigment is amorphous silica, and when amorphous silica is used for an ink receiving layer which does not contact the luster layer, it is preferable to use one having an average primary particle size of 3-70 nm and an average secondary particle size of 20 μm or less, and it is more preferable to use one having an average primary particle size of 5-40 nm and an average secondary particle size of 1.3 μm or less.

Also, it is preferable that the average secondary particle size of amorphous silica used in an ink receiving layer which does not contact a luster layer be larger than the average secondary particle size of amorphous silica used in an ink receiving layer which contacts the luster layer. This is because there is a danger that the ink absorptivity is reduced if the average secondary particle size of amorphous silica used in an ink receiving layer which does not contact a luster layer is smaller than the average secondary particle size of amorphous silica used in an ink receiving layer which contacts the luster layer.

Adhesive which may be used in an ink receiving layer is not particularly limited. For example, an aqueous resin, such as, polyvinyl alcohol (hereinafter referred to as PVA), polyvinyl acetal, polyethylene imine, polyvinyl pyrrolidone, and polyacrylamide, and an aqueous dispersion resin of vinylpolymer latex, such as, acrylpolymer latex and ethylene-vinyl acetate copolymer, may be suitably selected and used. Among them, use of PVA is preferable due to its excellent binder effect.

For a case in which PVA is used as an adhesive, it is preferable to use one whose degree of polymerization is between 3,000 and 5,000. By using PVA whose polymerization degree is in the above range, it becomes possible to reduce cracks in the ink receiving layer. Also, the degree of lowering in the ink absorbing rate becomes small since the degree of swelling of PVA caused by solvent contained in ink is small. The range of the degree of saponification of PVA is preferably 90-100%, and more preferably 95-100%. If the degree of saponification is less than 90%, there is a danger that the ink absorbing rate may be reduced due to swelling of PVA caused by solvent contained in ink.

As for the amount of adhesive, it is preferably about 3-100% by mass of pigment, and more preferably about 5-30% by mass of pigment. If the amount of adhesive is less than 3% by mass, cracks are easily generated in the ink receiving layer, and if the amount is more than 100% by mass, there is a danger that the adhesive will clog pores formed by pigment and lower the ink absorbing amount.

It is possible to add a cationic compound to an ink receiving layer, similar to the luster layer which will be described later, if necessary, to fix colorant contained in ink, to impart water resistance, and to improve a recording density. Although the cationic compound will be described later, one which can be added to the luster layer can also be added to the ink receiving layer. Moreover, different kinds of cationic compounds may be suitably selected for the luster layer and the ink receiving layer, and it is possible to use a plurality of cationic compounds at the same time.

A parting agent may be added to the ink receiving layer, similar to the luster layer, if necessary, to make the surface of recording paper be peeled off smoothly and stably from a calender roll. Although the parting agent will be described later, one which can be added to the luster layer can also be added to the ink receiving layer. Moreover, different kinds of parting agents may be suitably selected for the luster layer and the ink receiving layer, and it is possible to use a plurality of parting agents at the same time.

Furthermore, other than the above-mentioned materials, it is possible to add various pigments, dispersing agents, tackifiers, antifoaming agents, colorants, antistatic agents, preservatives, etc., which are generally used for manufacturing of coating paper, to an ink receiving layer.

An ink receiving layer may be formed by applying a coating solution in which components, such as the above-mentioned pigment, etc., are dispersed in solvent, and drying the coating solution. Although solvent of a coating solution is not particularly limited, it is preferable to use water due to appropriateness for coating and so forth.

Total coating amount of an ink receiving layer may be in the range of 5-70 g/m$^2$, preferably 10-50 g/m$^2$, and more preferably 15-40 g/m$^2$. Also, the total thickness of a coating layer may be 7-105 μm, preferably 15-75 μm, and more preferably 22-60 μm. If the coating amount is less than 5 g/m$^2$, there is a danger that not only a luster layer is insufficiently formed but also the ink absorptivity is reduced to deteriorate the recording suitability. Also, if the coating amount exceeds 70 g/m$^2$, the strength of the coating layer will be lowered and problems tend to be easily caused when printing paper is cut and processed or during transfer of recording paper in a printer.

The coating process may be carried out only once, or may be performed a plurality of times. If a plurality number of coating processes are carried out, it becomes possible to form a multiple-layer ink receiving layer. Also, if a coating solution is applied a plurality of times, not only can a large amount of the coating solution be applied while preventing the generation of cracks, but also the ink absorbing volume of the ink receiving layer can be increased.

As a coating device for an ink receiving layer, various known coating devices, such as a blade coater, an air-knife coater, a roll coater, a bar coater, a gravure coater, a die coater, and a curtain coater may be used. In particular, an air-knife coater can be suitably used since it can be appropriate for a wide variety of coating materials and coating amounts. Also, since the die coater and the curtain coater are excellent in maintaining a uniform coating amount, these are particularly preferable for ink jet printing paper of the luster type used for highly fine recording.

Although methods for drying a coated film are not particularly limited, various conventionally known and used heating and drying system, such as hot-blast drying, gas heater drying, high frequency drying, electronic heater drying, infrared heater drying, laser drying, and electron beam drying can be suitably adopted.

<Coating Solution Supplying Process>

Subsequently, a coating solution supplying process in which the coating solution 4 for forming a luster layer is supplied onto the ink receiving layer 3 is carried out.

(Luster Layer)

According to the present invention, a luster layer includes pigment, as its main component, and other arbitrary components, such as a parting agent.

If a primary particle, such as colloidal silica and alumina, is used for a luster layer, the ink absorbing rate tends to be lowered since the percentage of void is reduced. For this reason, the thickness of a luster layer is preferably 0.02-4 μm, and more preferably 0.05-2 μm. Also, it is preferable that the thickness of a luster layer be 1/10 or less of the total thickness of the ink receiving layer from the viewpoint of ink absorbing volume and ink absorbing rate. The thickness is preferably 1/20 or less, and more preferably 1/30 or less.

A coating solution for forming the luster layer may be prepared by dispersing the above components in an appropriate dispersing solvent.

Examples of pigment which may be contained in a luster layer include transparent or white pigment, such as colloidal silica, amorphous silica, alumina, aluminum hydroxide, magnesium carbonate, calcium carbonate, kaolin, and sintered kaolin. Among them, colloidal silica, alumina, and amorphous silica are particularly preferable pigment.

Colloidal silica and alumina are preferably used because these can enhance glossiness. The average primary particle size of colloidal silica or alumina may be 5-100 nm, preferably 10-80 nm, and more preferably 20-70 nm. If the average particle size is less than 5 nm, the ink absorptivity tends to decrease, and if the average particle size exceeds 100 nm, the transparency is reduced lowering the print concentration.

For the case in which amorphous silica is used, it is preferable to use one having an average primary particle size of 5-100 nm, and it is more preferable to use one having an average particle size of 5-40 nm. As for amorphous silica, it is preferable to use one having an average secondary particle size of 1 μm or less, and it is more preferable to use one having an average secondary particle size of 10-700 nm.

Although an aqueous resin may reduce the ink absorptivity, the resin can be suitably used for a case in which, for example, a resin type glossiness is required.

Example of the aqueous resin include polyvinyl alcohol, cation denatured polyvinyl alcohol, polyvinyl pyrrolidone and copolymer thereof; cellulose derivatives of polymethyl hydroxyl cellulose, carboxymethyl cellulose, etc.; denatured starch, such as oxidized starch and cationized starch; proteins, such as casein, soy-bean proteins and synthesized proteins; and aqueous resins, such as a polystyrene resin, a polybutadiene resin, a polyurethane resin, a polyacrylate resin, a polyvinylacrylate resin, a polyvinylchloride resin, and copolymers and denatured products thereof. These may be used singularly or in combination, and use of a styrene-acryl copolymer is particularly preferable.

It is preferable that an average particle size of an aqueous resin be in the range of 20-150 nm. If the particle size is less than 20 nm, there is a danger that the ink absorptivity thereof will be reduced, and if the particle size exceeds 150 nm, the transparency may be reduced to decrease the print concentration.

It is preferable that the glass transition temperature of an aqueous resin be in the range of 50-150° C. If the glass transition temperature is less than 50° C., a luster layer may be dried too quickly reducing the porosity thereof and lowering the ink absorptivity. If the glass transition temperature is higher than 150° C., a luster layer may be insufficiently formed to cause deficiency in glossiness and strength thereof.

The amount of an aqueous resin added is preferably in the range of 0-50, more preferably in the range of 0-10 with respect to 100 parts by mass of pigment.

Similar to the ink receiving layer, a cationic compound may be added to the luster layer, if necessary, to fix colorant contained in ink, to impart water resistance, and to improve recording density.

Examples of the cationic compounds include polyalkylene amines, such as polyethylene polyamine and polypropylene polyamine, and derivatives thereof; an acryl resin including, secondary, tertiary, or quaternary ammonium groups; polyvinyl amines; polyvinyl amidines; a dicyan cationic resin, typically a dicyandiamido-formalin polycondensed resin; a polyamine cationic resin, typically a dicyandiamido-diethylenetriamine polycondensed resin; a cationic compound, such as epichlorohydrin-dimethyl amine addition polymer, diallyldimethylammonium chloride-sulfur dioxide copolymer, diallylamine salt-sulfur dioxide copolymer, diallyldimethylammonium chloride polymer, polymer of allylamine salt, dialkylamine(meth)acrylate quaternary salt polymer, acrylamide-diallylamine salt copolymer; acrylonitrile-N-vinyl acrylamidinate copolymer and hydrolysate thereof and polyamidine. These may be used singularly or in combination.

Also, use of cationic colloidal silica is particularly preferable due to its excellent ink absorbing rate and print concentration.

It is preferable to add to a coating solution for forming a luster layer, other than the above-mentioned components, a parting agent in order to smoothly and stably separate the surface of a formed coating solution layer from a calender roll.

Examples of the parting agents include fatty acids, such as stearic acid, oleic acid and palmitic acid and their salts of sodium, potassium, calcium, zinc, ammonium, etc.; fatty acid amides, such as stearate amide, ethylene-bis-stearate amide and methylene-bis-stearate amide; aliphatic hydrocarbons, such as microcrystalline wax, paraffin wax, and polyethylene wax; higher alcohols, such as cetyl alcohol and stearyl alchol; fats and lipids, such as turkey-red oil and lecithin; various surfactants, such as fluorine containing surfactant; and fluorinated polymer, such as tetrafluoroethylene polymer and ethylene-tetrafluoroethylene polymer.

Among them, aliphatic hydrocarbons and their derivatives and denatured products, fatty acids and salts thereof, and lipids are preferable. In particular, use of polyethylene was as aliphatic hydrocarbon, stearic acid orollic acid as fatty acid, and lecithin as lipid is preferable.

Also, other than the above-mentioned materials, various pigments, dispersing agents, tackifiers, antifoaming agents, colorants, antistatic agents, conservatives, etc., which are generally used for manufacturing of coating paper, may be added to a luster layer.

Although solvent used for dispersing the above-mentioned components to prepare a coating solution is not particularly limited, it is preferable to use water due to appropriateness for coating and so forth.

Total solids concentration in a coating solution is preferably 0.1-15% by mass, and more preferably 0.5-10% by mass.

As for a coating amount of a luster layer, in terms of its dried mass, it may be in the range of 0.01-3 $g/m^2$, preferably 0.03-2 $g/m^2$, and more preferably 0.05-1 $g/m^2$. If the coating amount is less than 0.01 $g/m^2$, it becomes difficult to form a sufficient luster layer, and hence the glossiness tends to be lowered. Also, if the coating amount exceeds 3 $g/m^2$, although the glossiness may be obtained, the ink absorptivity and recording density tend to be lowered.

(Porosity)

Porosity may be easily measured since the volume of void can be measured using the above-mentioned mercury squeezing method.

The porosity "a" of an ink receiving layer is preferably $45<a<80\%$, more preferably $55\leqq a\leqq 75$ in order to absorb sufficient amount of ink. If the porosity a is less than 45%, the ink absorbing rate will be reduced, and if the porosity exceeds 80%, layer(s) of the ink receiving layer will become brittle, generating problems, such as peeling of a coating layer.

The porosity "b" of a luster layer is preferably $10<b\leqq 45\%$, more preferably $20\leqq a\leqq 40$ so that sufficiently high glossiness may be obtained. If the porosity b is less than 10%, the ink absorptivity will be inhibited and hence the ink absorbing rate will be significantly reduced. If the porosity exceeds 45%, the surface smoothness will be lowered to cause lowering in glossiness.

Also, $a>b$ and $a-b>25$. If $a-b>25$, the balance between the glossiness and the ink absorptivity will be disturbed and problems may be caused.

<Pressing Process>

Subsequently, a pressing process is performed in which, while the supplied coating solution 4 is in a wet state or in a half-dried state, the supporting sheet 2 is passed between the calender roll 5 and the press roll 6, to which pressure is applied, so that the surface to which the coating solution 4 has been supplied contacts the calender roll 6, and immediately after this, the coating solution layer 7 is separated from the calender roll 5.

The coating solution layer 7 will be formed on the ink receiving layer 3 by pressing the surface to which the coating solution 4 is supplied using the press roll 6 so that the surface to which coating solution 4 is supplied contacts the calender roll 5 while the coating solution 4 is in the wet or in the half-dried state. During that period, the coating solution layer 7 is closely contacted with the ink receiving layer 3 due to applied pressure and heat, and a uniform film having no cracks will be formed.

It is possible to carry out a drying process after the pressing process, in which the coating solution layer 7 is dried in, for example, a drying zone, such as the dryer 9.

The surface temperature of the calender roll is preferably 40-130° C. and more preferably 70-120° C. from the viewpoints of operability, such as drying conditions, adhesion to the ink receiving layer, and glossiness of the surface of the luster layer. If the surface temperature of the calender roll is less than 40° C., a film will not be formed by adhesive contained in the coating solution and the surface strength of ink jet printing paper may be lowered or the adhesion to the ink receiving layer may be deteriorated. If the surface temperature of the calender roll exceeds 130° C., the ink absorptivity may be lowered since too much film is formed by the adhesive contained in the coating solution layer, or the coating solution 4 will be boiled, degrading the luster surface.

Also, the calender roll is preferably a metal roll due to its excellent heat resistance and properties from which excellent specular characteristics may be obtained. Moreover, it is possible to form minute roughnesses on a metal roll when so-called half-luster paper whose glossiness is reduced by forming minute roughness on the surface is to be obtained. Although a mean line-centered roughnesses Ra of a calender roll varies depending on a targeted glossiness, it may be 10 μm or less, for example.

The material used for a press roll is preferably a heat resistant resin in order to more evenly apply pressure between the above-mentioned calender roll.

It is preferable that pressure be applied using a press roll so that the linear load between the calender roll and the press roll becomes 50-3500 N/cm, preferably 200-3000 N/cm. If the linear load between the calender roll and the press roll is less than 50 N/cm, the linear pressure is difficult to make uniform and the glossiness may be reduced, or the adhesion of the coating solution 7 with respect to the ink receiving layer 3 is reduced, causing cracks on the surface. If the linear load exceeds 3500 N/cm, voids present in the ink receiving layer and the luster layer are destroyed by the excessive pressure applied to ink jet printing paper, and hence the ink absorptivity thereof may be reduced.

<Drying (Humidity Adjusting) Process>

According to the present invention, water components in the ink jet printing paper 1 (the supporting sheet 2, the ink receiving layer 3, and the coating solution layer 7) immediately after being separated from the calender roll 5 are in a wet state or in a half-dried state. Although the moisture content in the coating layer is largely influenced by the coating amount of the ink receiving layer and the luster layer, it is 7-100%, for example.

A humidity adjusting or drying device is unnecessary for the case in which water contents reach equilibrium during a period after the paper is separated from the calender roll 5 and before being wound by a winder. However, for the case where a coating speed is high and a large amount of water is contained in the supporting sheet 2, a humidity adjusting process using a humidity adjusting device or a drying process using a drying device becomes necessary during a period after the paper is separated from the calender roll 5 and before being wound by a winder. The performance and manner of a humidity adjusting device or a drying device may be suitably adjusted based on the difference between the water components present in the ink jet printing paper when it is separated from the calender roll 5 and equilibrium water components, and the coating speed.

Note that in order to obtain a level of silver halide photography, 75° surface glossiness (based on JIS P 8142) of the surface of the luster layer 9 formed in the above-mentioned manner may be 70% or higher, preferably 75% or higher, and more preferably 80% or higher. Also, the image clarity (based on JIS H 8686-2) thereof when an optical comb having a width of 2.0 mm is used may be 55% or higher, preferably 57% or higher, more preferably 60% or higher, and most preferably 65% or higher.

Note that in FIG. 1, although the calender roll 5 and the press roll 6 are arranged in a row in the right and left direction and the coating solution reservoir is formed above the tangent line connecting the calender roll 5 and the press roll 6 so that the supporting sheet is passed through in the longitudinal direction, it is possible, for example, to arrange the calender roll 5 and the press roll 6 in a row in the up and down direction and supply the coating solution 4 onto the ink receiving layer 3 so that the supporting sheet may be passed though in the transverse direction.

Hereinafter, the present invention will be explained in detail with reference to examples. However, it is apparent that the present invention is not limited to those examples. Also, "parts" and "%" used in the examples indicate "parts by mass" and "% by mass" unless otherwise so indicated.

(Silica Sol A)

After commercially available sedimentation method silica (commercial name: Finesil X-45, a product of Tokuyama Co., Ltd.; average primary particle size of 10 nm, specific surface area of 280 $m^2/g$, average secondary particle size of 4.5 μm) was dispersed in water and pulverized using a sand grinder, pulverization and dispersion were repeated using a nanomizer (commercial name: Nanomizer, a product of Nanomizer Co.) and after classification, 10% dispersion having an average secondary particles size of 80 nm was prepared. As a cationic compound, 10 parts of diallyldimethylammonium chloride (commercial name: Unisence CP-103, a product of Senka Co.) was added to the dispersion to cause aggregation of pigment and increase the viscosity of the dispersion, and then pulverization and dispersion were repeated again using the nanomizer to prepare 8% dispersion having an average secondary particle size of 250 nm, from which silica sol A was obtained.

(Silica Sol B)

After commercially available sedimentation method silica (commercial name: Finesil X-45, a product of Tokuyama Co., Ltd.; average primary particle size of 10 nm, specific surface area of 280 $m^2/g$, average secondary particle size of 4.5 μm) was dispersed in water and pulverized using a sand grinder, pulverization and dispersion were repeated using a nanomizer (commercial name: Nanomizer, a product of Nanomizer Co.) and after classification, 10% dispersion having an average secondary particles size of 80 nm was prepared. As a cationic compound, 10 parts of diallyldimethylammonium chloride (commercial name: Unisence CP-103, a product of Senka Co.) was added to the dispersion to cause aggregation of pigment and increase the viscosity of the dispersion, and then pulverization and dispersion were repeated again using the nanomizer to prepare 8% dispersion having an average secondary particle size of 1.3 μm, from which silica sol B was obtained.

(Silica Sol C)

After commercially available gel method silica (commercial name: Nipsil AZ600, a product of Nippon Silica Co., Ltd.; average primary particle size of 10 nm, specific surface area of 300 $m^2/g$) was dispersed in water and pulverized using a sand grinder, pulverization and dispersion were repeated using a nanomizer (commercial name: Nanomizer, a product of Nanomizer Co.) and after classification, 10% dispersion having an average secondary particles size of 80 nm was prepared. As a cationic compound, 10 parts of diallyldimethylammonium chloride (commercial name: Unisence CP-103, a product of Senka Co.) was added to the dispersion to cause aggregation of pigment and increase the viscosity of the dispersion, and then pulverization and dispersion were repeated again using the nanomizer to prepare an 8% dispersion having an average secondary particle size of 300 nm, from which silica sol C was obtained.

(Silica Sol D)

After commercially available gas phase method silica (commercial name: Reolosil QS-30, a product of Tokuyama Co., Ltd.; average primary particle size of 10 nm, specific surface area of 300 $m^2/g$) was dispersed in water and pulverized using a sand grinder, pulverization and dispersion were repeated using a nanomizer (commercial name: Nanomizer, a product of Nanomizer Co.) and after classification, 10% dispersion having an average secondary particles size of 80 nm was prepared. As a cationic compound, 10 parts of diallyldimethylammonium chloride (commercial name: Unisence CP-103, a product of Senka Co.) was added to the dispersion to cause aggregation of pigment and increase the viscosity of the dispersion, and then pulverization and dispersion were repeated again using the nanomizer to prepare an 8% dispersion having an average secondary particle size of 300 nm, from which silica sol D was obtained.

(Silica Sol E)

After commercially available sedimentation method silica (commercial name: Finesil X-45, a product of Tokuyama Co., Ltd.; average primary particle size of 10 nm, average secondary particle size of 4.5 μm) was dispersed in water and pulverized using a sand grinder, pulverization and dispersion were repeated using a nanomizer (commercial name: Nanomizer, a product of Nanomizer Co.) and after classification, 20% dispersion having an average secondary particles size of 500 nm was prepared, from which silica sol E was obtained.

(Alumina Sol A)

After commercially available alumina particle (commercial name: AKP-G020, a product of Sumitomo Chemical Co., Ltd.; BET specific surface area of 200 $m^2/g$, γ-alumina) was dispersed in water and pulverized using a sand grinder, pulverization and dispersion were repeated using a microfluidizer to prepare 10% dispersion having an average secondary particle size of 200 nm, from which alumina sol was obtained.

(Supporting Sheet A)

N-bleached kraft pulp (NBKP) which was beaten until CSF (JIS P-8121) reached 250 mL and L-bleached kraft pulp (LBKP) which was beaten until CSF reached 250 mL were mixed in a 2:8 ratio to prepare a pulp slurry of 0.5% concentration. To the pulp slurry, 2.0% cationized starch, 0.4% alkylketene dimer, 0.1% anionized polyacryl amide resin, and 0.7% polyamide polyamine epichlorohydrin resin, with respect to the absolute dry weight of pulp, were added and sufficiently mixed to be dispersed in the slurry.

The pulp slurry having the above-mentioned composition was subjected to a Fourdrinier paper machine and passed through a drier, a size-press, and a machine calender to obtain base paper having an areal weight of 180 g/m$^2$, and a density of 1.0 g/cm$^3$. The size press solution used for the above-mentioned size press process was prepared by mixing carboxy denatured polyvinyl alcohol and sodium chloride in 2:1 mass ratio, adding water to the mixture, subjecting the mixture to an overheat melting process, and adjusting the concentration thereof to 5%. The size press solution was applied, in total amount of 25 mL/m$^2$, to both sides of paper to obtain a supporting sheet A (permeability: 300 seconds).

(Supporting Sheet B)

After both sides of the base paper including the above supporting sheet A were subjected to a corona discharge treatment, a polyolefin resin composition 1 described below, which was mixed and dispersed using a Banbury mixer, was applied onto a felt surface side of the supporting sheet A so that the coated amount was 25 g/m$^2$, and a polyolefin composition 2 described below was applied onto a wire side of the supporting sheet A so that a coating amount was 20 g/m$^2$, using a melt extruder (melting temperature of 320° C.). Then, the felt surface side and the wire surface side were cooled and solidified using a cooling roll having a specular surface and a rough surface, respectively, to obtain a supporting sheet B covered by a resin (permeability: >10,000 seconds) whose degree of smoothness (Oken type, J. TAPPI No. 5) was 6,000 seconds and opacity (JIS P8138) was 93%.

(Polyolefin Resin Composition 1)

A long chain type low density polyethylene resin (density: 0.926 g/cm$^3$, melt index: 20 g/10 minutes) (35 parts), a low density polyethylene resin (density: 0.919 g/cm$^3$, melt index: 2 g/10 minutes) (50 parts), anatase type titanium dioxide (commercial name: A-220, a product of Ishihara Sangyo Kaisha, Ltd.) (15 parts), zinc stearate (0.1 part), antioxidant (commercial name: Irganox 1010, a product of Ciba-Geigy Japan Ltd.) (0.03 parts), ultramarine blue (commercial name: Aokuchigunjyo No. 2000, a product of Daiichi Kasei Co.) (0.09 parts), and a fluorescent brightener (commercial name: Uvitex OB, a product of Ciba-Geigy Japan Ltd.) (0.3 parts) were mixed and used as a polyolefin resin composition 1.

(Polyolefin Resin Composition 2)

A high density polyethylene resin (density: 0.954 g/cm$^3$, melt index: 20 g/10 minutes) (65 parts), and a low density polyethylene resin (density: 0.919 g/cm$^3$, melt index: 2 g/10 minutes) (35 parts) were melt-mixed and used as a polyolefin resin composition 2.

(Supporting Sheet C)

N-bleached kraft pulp (NBKP) which was beaten until CSF (JIS P-8121) reach 250 mL and L-bleached kraft pulp (LBKP) which was beaten until CSF reach 250 mL were mixed in a 2:8 ratio to prepare a pulp slurry of 0.5% concentration. To the pulp slurry, 2.0% cationized starch, 0.4% alkylketene dimer, 0.1% anionized polyacryl amide resin, and 0.7% polyamide polyamine epichlorohydrin resin, with respect to the absolute dry weight of pulp, were added and sufficiently mixed to be dispersed in the slurry.

The pulp slurry having the above-mentioned composition was subjected to a Fourdrinier paper machine and passed through a drier, and a machine calender to manufacture base paper having an areal weight of 150 g/m$^2$, and a density of 0.75 g/cm$^3$, and a supporting sheet C (permeability: 35 seconds) was obtained.

EXAMPLE 1

The silica sol A (100 parts) was mixed with 5% polyvinyl alcohol (commercial name: Kuraray poval PVA-135H, a product of Kuraray Co. Ltd.; polymerization degree: 3500, saponification degree: 99% or higher) (24 parts), and the mixture was applied onto the supporting sheet B using a Meyer bar so that the coating amount became 25 g/m$^2$ (the thickness of the coating layer was 38 μm) and was dried to form an ink receiving layer. Then, colloidal silica having an average particle size of 25 nm (commercial name: Snowtex 50, a product of Nissan Chemical Industries, Ltd.) was diluted to 10%, and applied onto the ink receiving layer as shown in FIG. 1. While it was in a wet state, the ink receiving layer was pressed against a specular drum with a chromium plating finish whose surface temperature was 100° C. at a linear pressure of 2000 N/cm to form a luster layer. After this, it was dried at 100° C. for 15 minutes to obtain ink jet printing paper. Note that the coating amount of the luster layer was 0.5 g/m$^2$, and the thickness thereof was 1 μm.

EXAMPLE 2

Ink jet printing paper was obtained in the same manner as in Example 1 except that 100 parts of the silica sol B was used instead of 100 parts of the silica sol A.

EXAMPLE 3

Ink jet printing paper was obtained in the same manner as in Example 1 except that 100 parts of the silica sol C was used instead of 100 parts of the silica sol A.

EXAMPLE 4

Ink jet printing paper was obtained in the same manner as in Example 1 except that 100 parts of the silica sol D was used instead of 100 parts of the silica sol A.

EXAMPLE 5

Ink jet printing paper was obtained in the same manner as in Example 1 except that 100 parts of the alumina sol A was used instead of 100 parts of the silica sol A.

EXAMPLE 6

The silica sol E (100 parts) was mixed with 5% polyvinyl alcohol (commercial name: Kuraray poval PVA-135H, a product of Kuraray Co. Ltd.; polymerization degree: 3500, saponification degree: 99% or higher) (24 parts), and the mixture was applied onto the supporting sheet B using a Meyer bar so that the coating amount became 20 g/m$^2$ and was dried to form a second ink receiving layer. Then, the silica sol A (100 parts) was mixed with 5% polyvinyl alcohol (commercial name: Kuraray poval PVA-135H, a product of Kuraray Co. Ltd.; polymerization degree: 3500, saponification degree: 99% or higher) (24 parts) and this was applied onto the second ink receiving layer using the Meyer bar so that the coating amount became 5 g/m$^2$ and was dried to form a first ink receiving layer. The thickness of the total ink receiving layer was 38 μm. After this, colloidal silica (commercial name: Snowtex 50, a product of Nissan Chemical Industries, Ltd.) was diluted to 10%, and applied onto the first ink receiving layer. While it was in a wet state, the ink receiving layer was pressed against a specular drum with a chromium plating finish whose surface temperature was 100° C. at a linear pressure of 2000 N/cm to form a luster layer. After this, it was dried at 100° C. for 15 minutes to obtain ink jet printing paper. Note that the coating amount of the luster layer was 0.5 g/m$^2$, and the thickness thereof was 1 μm.

EXAMPLE 7

Ink jet printing paper was obtained in the same manner as in Example 6 except that Sylojet 703A (a product of Grace Davison Co., specific surface area: 280 m$^2$/g, average secondary particle size: 300 nm) was used instead of 100 parts of the silica sol E in the formation of the second ink receiving layer in Example 6.

EXAMPLE 8

Ink jet printing paper was obtained in the same manner as in Example 6 except that colloidal silica having an average particle size of 15 nm (commercial name: Snowtex AK, a product of Nissan Chemical Industries, Ltd.) was used instead of the colloidal silica (commercial name: Snowtex 50, a product of Nissan Chemical Industries, Ltd.).

EXAMPLE 9

Ink jet printing paper was obtained in the same manner as in Example 6 except that the silica sol A was used instead of the colloidal silica (commercial name: Snowtex 50, a product of Nissan Chemical Industries, Ltd.).

EXAMPLE 10

Ink jet printing paper was obtained in the same manner as in Example 6 except that alumina sol having an average particle size of 15 nm (commercial name: Alumina Sol 520, a product of Nissan Chemical Industries, Ltd.) was used instead of the colloidal silica (commercial name: Snowtex 50, a product of Nissan Chemical Industries, Ltd.)

EXAMPLE 11

Ink jet printing paper was obtained in the same manner as in Example 6 except that colloidal silica having an average particle size of 25 nm (commercial name: Snowtex CM, a product of Nissan Chemical Industries, Ltd.) was used instead of the colloidal silica (commercial name: Snowtex 50, a product of Nissan Chemical Industries, Ltd.)

EXAMPLE 12

Ink jet printing paper was obtained in the same manner as in Example 6 except that colloidal silica having an average particle size of 25 nm (commercial name: Snowtex O40, a product of Nissan Chemical Industries, Ltd.) was used instead of the colloidal silica (commercial name: Snowtex 50, a product of Nissan Chemical Industries, Ltd.)

EXAMPLE 13

Ink jet printing paper was obtained in the same manner as in Example 12 except that a linear pressure of 3500 N/cm was applied instead of the linear pressure of 2000 N/cm in the formation of the luster layer. The thickness of the ink receiving layer was 35 μm, and the thickness of the luster layer was 0.8 μm.

EXAMPLE 14

Ink jet printing paper was obtained in the same manner as in Example 12 except that a linear pressure of 50 N/cm was applied instead of the linear pressure of 2000 N/cm in the formation of the luster layer. The thickness of the luster layer was 1.5 μm.

EXAMPLE 15

Ink jet printing paper was obtained in the same manner as in Example 12 except that the ink receiving layer was pressed against a specular drum with a chromium plating finish whose surface temperature was 40° C. instead of a specular drum with a chromium plating finish whose surface temperature was 100° C.

EXAMPLE 16

Ink jet printing paper was obtained in the same manner as in Example 12 except that commercially available polypropylene synthetic paper (commercial name: Yupo GWG-140, a product of Yupo Corporation) was used instead of the supporting sheet B.

COMPARATIVE EXAMPLE 1

Ink jet printing paper was obtained in the same manner as in Example 12 except that the supporting sheet C was used instead of the supporting sheet B.

COMPARATIVE EXAMPLE 2

Ink jet printing paper was obtained in the same manner as in Example 1 except that no luster layer was formed.

EXAMPLE 17

A coating solution for a second ink receiving layer was formed by mixing 100 parts of a gel method silica (commercial name: Sylojet P612, a product of Grace Davison Co., average primary particle size: 10 nm, average secondary particle size: 7.5 μm) with 35 parts of silyl denatured polyvinyl alcohol (commercial name: Kuraray poval PVA R-1130, Kuraray Co., Ltd., polymerization degree 1700) so that the concentration thereof became 15%, and this was applied onto the supporting sheet B using a die coater so that the dried coating amount became 15 g/m$^2$.

Before the coating applied onto the second ink receiving layer was dried, a coating solution for a first ink receiving layer, which was formed by mixing 100 parts of the silica sol A was mixed with 30 parts of polyvinyl alcohol (commercial name: Kuraray poval PVA 135H, a product of Kuraray Co. Ltd., polymerization degree of 3500) so that the concentration thereof became 8%, was applied using a die coater so that the dried coating amount became 5 g/m$^2$, and dried to form the first and second ink receiving layer. At that time the thickness of the ink receiving layer was 28 μm.

Then, 100 parts of a 50:50 complex of sterene-2-hexylacrylate copolymer having a glass transition point of 85° C. and a colloidal silica having an average particle size of 30 nm, 5 parts of alkylvinyl ether-maleic acid derivative reins as a viscosity regulator, and 3 parts of lecithin as a parting agent were mixed and dispersed in water to form a coating solution for a luster layer having 10% solid concentration. This was applied onto the first ink receiving layer, and immediately after this it was pressed against a specular drum with a chromium plating finish whose surface temperature was 100° C. with a linear pressure of 50 kg while the coating solution for luster layer was in a wet state, to obtain ink jet printing paper. At that time, the dried coating amount of the coating solution for luster layer was 2 g/m$^2$. Also, the thickness of the luster layer was 2.5 μm.

EXAMPLE 18

Ink jet printing paper was obtained in the same manner as in Example 17 except that the coating solution for the first ink receiving layer was used instead of the coating solution for the second ink receiving layer in the formation of the second ink receiving layer. The thickness of the ink receiving layer was 30 μm.

EXAMPLE 19

Ink jet printing paper was obtained in the same manner as in Example 17 except that commercially available polypropylene synthetic paper (commercial name: Yupo GWG-140, a product of Yupo Corporation, permeability: >10000 seconds) was used instead of the supporting sheet B.

COMPARATIVE EXAMPLE 3

Ink jet printing paper was obtained in the same manner as in Example 17 except that the supporting sheet C was used instead of the supporting sheet B.

EXAMPLE 20

The silica sol D (100 parts) was mixed with 5% polyvinyl alcohol (commercial name: kuraray poval PVA-135H, a product of Kuraray Co. Ltd.; polymerization degree: 3500, saponification degree: 99% or higher) (24 parts), and the mixture was applied onto the supporting sheet B using a Meyer bar so that the coating amount became 25 g/m$^2$ and was dried to form an ink receiving layer. The thickness of the ink receiving layer was 37 μm. Then, colloidal silica having an average particle size of 25 nm (commercial name: Snowtex O40, a product of Nissan Chemical Industries, Ltd.) was diluted to 10%, and applied onto the ink receiving layer. While it was in a wet state, the ink receiving layer was pressed against a specular drum with a chromium plating finish whose surface temperature was 100° C. at a linear pressure of 2000 N/cm to form a luster layer. After this, it was dried at 100° C. for 15 minutes to obtain ink jet printing paper. The thickness of the luster layer was 1 μm.

EXAMPLE 21

The silica sol D (100 parts) was mixed with 5% polyvinyl alcohol (commercial name: Kuraray poval PVA-135H, a product of Kuraray Co. Ltd.; polymerization degree: 3500, saponification degree: 99% or higher) (24 parts), and the mixture was applied onto the supporting sheet B using a Meyer bar so that the coating amount became 25 g/m$^2$ and was dried to form an ink receiving layer. The thickness of the ink receiving layer was 37 μm. Then, 1 part of 2% polyvinyl alcohol (commercial name: Kuraray poval PVA R-1130, a product of Kuraray Co., Ltd., polymerization degree: 1170) was mixed with the colloidal silica having an average particle size of 25 nm (commercial name: Snowtex O40, a product of Nissan Chemical Industries, Ltd.), and was applied onto the ink receiving layer using a Meyer bar. After this, it was dried at 100° C. for 15 minutes to obtain ink jet printing paper. The thickness of the luster layer was 1.5 μm.

EXAMPLE 22

Ink jet printing paper was obtained in the same manner as in Example 20 except that a colloidal silica having an average particle size of 100 nm (commercial name: Snowtex MP 1040, a product of Nissan Chemical Industries, Ltd.) was used instead of the colloidal silica (commercial name: SnowtexO40, a product of Nissan Chemical Industries, Ltd.).

EXAMPLE 23

Ink jet printing paper was obtained in the same manner as in Example 20 except that a colloidal silica having an average particle size of 45 nm (commercial name: Snowtex 20L, a product of Nissan Chemical Industries, Ltd.) was used instead of the colloidal silica (commercial name: SnowtexO40, a product of Nissan Chemical Industries, Ltd.).

EXAMPLE 24

Ink jet printing paper was obtained in the same manner as in Example 20 except that a colloidal silica having an average particle size of 5 nm (commercial name: Snowtex XS, a product of Nissan Chemical Industries, Ltd.) was used instead of the colloidal silica (commercial name: SnowtexO40, a product of Nissan Chemical Industries, Ltd.).

EXAMPLE 25

Ink jet printing paper was obtained in the same manner as in Example 20 except that polyvinyl alcohol (commercial name: Kuraray poval PVA-117, a product of Kuraray Co. Ltd.; polymerization degree: 1700, saponification degree: 99% or higher) was used instead of 24 parts of the 5% polyvinyl alcohol (commercial name: Kuraray poval PVA-135H, a product of Kuraray Co. Ltd.; polymerization degree: 3500, saponification degree: 99% or higher).

TEST EXAMPLE 1

Evaluation of ink jet printing paper obtained in Examples and Comparative Examples in terms of 75 degree surface glossiness, image clarity, cockling, printing glossiness, ink absorptivity, and print concentration is shown in Table 1. Each of the items of the evaluation was measured using the following methods. (75° surface glossiness)

The 75° surface glossiness of the ink jet printing paper was measured using a method specified in JIS P 8142.

(Image Clarity)

The image clarity of a white paper portion at an optical comb of 2.0 mm at 45° reflection was measured, based on a method specified in JIS H 8686-2, using an image clarity measuring device (ICM-1DP, a product of Suga Test Device Co., Ltd.) so that a coating direction became perpendicular to a slit. The figures shown in Table 1 indicate an average value of five measurements.

(Cockling)

Cockling was measured using an ink jet printer BJF 870 (a product of Canon Inc.). Ink cartridges used were BCI-6C, BCI-6M, BCI-6Y, BCI-Bk, BCI-6PC, and BCI-6PM photo of Canon Inc. Evaluation was made by visually observing cockling generated in a solid portion of a mixed ink including cyan ink and magenta ink.

○: no cockling was observed and printing was in excellent condition;

Δ: some cockling was observed and may become a problem under some circumstances;

X: significant level of cockling was observed which made the paper practically unusable.

(Printing Glossiness)

The above-mentioned solid portion for cockling was visually evaluated.

○: printing glossiness was visually observed and was of excellent condition;

Δ: printing glossiness visually observed was somewhat low;

X: printing glossiness visually observed was low, and no glossy feeling was obtained.

(Ink Absorptivity)

The above-mentioned solid portion for cockling was visually evaluated.

○: no unevenness was observed and in excellent condition;

Δ: some unevenness was observed and may become a problem under some circumstances.

(Print Concentration)

Print concentration was measured using an ink jet printer BJF 870 (a product of Canon Inc.). Ink cartridges used were BCI-6C, BCI-6M, BCI-6Y, BCI-Bk, BCI-6PC, and BCI-6PM photo of Canon Inc. Evaluation was made by measuring a black solid portion using a Macbeth reflection densitometer (RD-914, a product of Macbeth Co.).

(Porosity and Specific Surface Area-Based Pore Mode Diameter)

Porosity and specific surface area-based pore mode diameter were calculated by measuring a total pore specific surface area and total pore volume based on a mercury squeezing method using a Micrometrix poresizer 9320 (a product of Shimadzu Corporation).

All of the ink jet printing paper produced in Examples 1-25 (of the present invention) had surface glossiness and image clarity which were higher than those of a case in which only an ink receiving layer was present. In particular, for the case in which pigment having an average primary particle size of 5-100 nm was used for a luster layer, a 75° surface glossiness of 70% or higher and an image clarity of 55% or higher were obtained, and absolutely no cockling was observed. Also, the print glossiness and ink absorptivity thereof were excellent and the print concentration thereof was high.

That is, all of the ink jet printing paper obtained in Examples 1-25 (of the present invention) had excellent appearance with high glossiness and no cockling. Also, the print glossiness and ink absorptivity thereof were excellent, and had superior recording properties with high recording concentration.

By comparing Example 12 with Comparative Example 1, the ink jet printing paper of Example 12 in which the low permeability (permeability: >10,000 seconds) supporting sheet B was used had better results in all of the evaluated items than Comparative Example 1 in which the high permeability (permeability: >35 seconds) supporting sheet C was used.

By comparing Example 1 with Comparative Example 2, although the ink absorptivity of the ink jet printing paper of Comparative Example 2 having no luster layer was equivalent to that of Example 1, all of the other results of Comparative Example 2 were inferior to the ink jet printing paper of Example 1.

By comparing Example 17 (in which the supporting sheet B was used as a supporting sheet) with Comparative Example 3 (in which the supporting sheet A was used as a supporting sheet), the ink jet printing paper (Example) having the low permeability supporting sheet B had better results than the Comparative Example in all of the evaluated items including the surface glossiness and clarity.

TABLE 1

| | 75° surface glossiness | Mapping | Cockling | Print glossiness | Ink absorptivity | Print concentration | a | b | Mode diameter (nm) |
|---|---|---|---|---|---|---|---|---|---|
| Ex. 1 | 78 | 77 | ○ | ○ | ○ | 2.35 | 60 | 30 | 20 |
| Ex. 2 | 71 | 70 | ○ | Δ | ○ | 2.26 | 57 | 30 | 90 |
| Ex. 3 | 78 | 77 | ○ | ○ | ○ | 2.35 | 60 | 30 | 20 |
| Ex. 4 | 80 | 79 | ○ | ○ | ○ | 2.37 | 67 | 30 | 25 |
| Ex. 5 | 83 | 79 | ○ | ○ | ○ | 2.40 | 62 | 30 | 23 |
| Ex. 6 | 78 | 75 | ○ | ○ | ○ | 2.40 | 63 | 30 | 35 |
| Ex. 7 | 80 | 75 | ○ | ○ | ○ | 2.41 | 60 | 30 | 30 |
| Ex. 8 | 80 | 77 | ○ | ○ | ○ | 2.50 | 60 | 25 | 30 |
| Ex. 9 | 60 | 75 | ○ | ○ | ○ | 2.25 | 60 | 55 | 30 |
| Ex. 10 | 83 | 79 | ○ | ○ | ○ | 2.47 | 60 | 25 | 28 |
| Ex. 11 | 78 | 75 | ○ | ○ | ○ | 2.40 | 60 | 30 | 32 |
| Ex. 12 | 80 | 76 | ○ | ○ | ○ | 2.48 | 60 | 30 | 32 |
| Ex. 13 | 85 | 67 | ○ | ○ | Δ | 2.47 | 55 | 30 | 25 |
| Ex. 14 | 73 | 83 | ○ | Δ | ○ | 2.25 | 60 | 28 | 32 |
| Ex. 15 | 75 | 79 | ○ | ○ | ○ | 2.27 | 60 | 30 | 32 |
| Ex. 16 | 80 | 79 | ○ | ○ | ○ | 2.48 | 60 | 30 | 32 |
| C. Ex. 1 | 57 | 31 | X | X | ○ | 1.98 | 60 | 30 | 32 |
| C. Ex. 2 | 48 | 37 | ○ | X | ○ | 2.22 | 60 | — | 38 |
| Ex. 17 | 75 | 75 | ○ | Δ | ○ | 2.22 | 53 | 23 | 100 |
| Ex. 18 | 85 | 76 | ○ | ○ | ○ | 2.31 | 60 | 24 | 20 |
| Ex. 19 | 75 | 78 | ○ | Δ | ○ | 2.25 | 53 | 23 | 100 |
| C. Ex. 3 | 60 | 52 | Δ | X | ○ | 2.03 | 53 | 23 | 100 |
| Ex. 20 | 82 | 77 | ○ | ○ | ○ | 2.49 | 67 | 30 | 25 |
| Ex. 21 | 78 | 60 | ○ | Δ | ○ | 2.51 | 67 | 40 | 30 |
| Ex. 22 | 77 | 75 | ○ | ○ | ○ | 2.31 | 67 | 35 | 30 |
| Ex. 23 | 79 | 77 | ○ | ○ | ○ | 2.40 | 67 | 33 | 30 |
| Ex. 24 | 85 | 78 | ○ | ○ | Δ | 2.48 | 60 | 20 | 18 |
| Ex. 25 | 82 | 76 | ○ | ○ | Δ | 2.41 | 67 | 30 | 25 |

Also, although the glossiness may be improved by decreasing an average primary particle size of fine pigment used in a glossy layer without changing the secondary particle size of fine powder used in an ink receiving layer, the ink absorptivity thereof is reduced if it reaches 8 nm. Also, as the average primary particle size increases, the print concentration is gradually decreases.

By comparing Examples 1, 3, and 4 with Example 2, the ink jet printing paper of Examples 1, 3, and 4 in which a silica sol having an average secondary particle size of 1.3 μm or less had excellent 75° surface glossiness, print glossiness, and print concentration.

By comparing Example 20 with Example 25, it was found out that the ink absorptivity was improved when PVA having a polymerization degree of 3500 was used instead of PVA having a polymerization degree of 1700, and the print concentration thereof was also improved.

INDUSTRIAL APPLICABILITY

As mentioned above, according to the present invention, a coating solution for forming a luster layer on an ink receiving layer is supplied and while the coating solution is in a wet state or in a half-dry state, the supporting sheet is passed through a calender roll and a press roll to which a load is applied, so that a surface to which the coating solution has been applied contacts the calender roll to form a coating solution layer. Then, the coating solution layer is immediately separated from the calender roll to form a luster layer. Whereas in conventional methods for producing cast coated paper, after a coated layer surface in a wet plasticized state is pressure fused using a heated calender roll and is dried to form a luster surface, it is separated from the calender roll to copy a specular surface.

The ink jet printing paper according to the present invention has a high surface glossiness with little decrease of ink absorptivity and ink absorbing speed, generates no cracks, and has excellent ink jet recording properties with a superior dot reproducibility.

The invention claimed is:

1. Ink jet printing paper, comprising:

a low permeability or nonpermeable supporting sheet;

at least one ink receiving layer coated on said supporting sheet; and a luster layer coated on said ink receiving layer, wherein said luster layer comprises a pigment as a main component having an average primary particle size of 5 to 100 nm, wherein said ink receiving layer in contact with said luster layer comprises a pigment, as a main component, having a specific surface area-based mode diameter of pore distribution of 100 nm or less and an average secondary particle size of 1.3 μm or less, wherein said ink receiving layer has a porosity of less than 80% but greater than 45% and said luster layer has a porosity of 45% or less but greater than 10%, and wherein the difference between the porosity of the ink receiving layer and the porosity of the luster layer is greater than 25%.

2. Ink jet printing paper according to claim 1, wherein on the surface of said luster layer, 75° surface glossiness is 70% or more and image clarity measured using an optical comb having a width of 2.0 mm is 55% or higher.

3. Ink jet printing paper according to claim 1, wherein a thickness of said luster layer is 0.02-4 μm, and the thickness is 1/10 or less of a total thickness of said ink receiving layer.

4. Ink jet printing paper according to claim 1, wherein at least one layer of said ink receiving layer includes pigment and adhesive, the adhesive being polyvinyl alcohol having a polymerization degree of 3000-5000.

5. Ink jet printing paper according to claim 1, wherein said supporting sheet is a film or resin coated paper.

* * * * *